US008657968B2

(12) United States Patent
Sakai et al.

(10) Patent No.: US 8,657,968 B2
(45) Date of Patent: Feb. 25, 2014

(54) GRAIN-ORIENTED ELECTRICAL STEEL SHEET AND METHOD OF MANUFACTURING THE SAME

(75) Inventors: Tatsuhiko Sakai, Tokyo (JP); Hideyuki Hamamura, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/816,773

(22) PCT Filed: Sep. 9, 2011

(86) PCT No.: PCT/JP2011/070607
§ 371 (c)(1),
(2), (4) Date: Feb. 13, 2013

(87) PCT Pub. No.: WO2012/033197
PCT Pub. Date: Mar. 15, 2012

(65) Prior Publication Data
US 2013/0139932 A1 Jun. 6, 2013

(30) Foreign Application Priority Data
Sep. 9, 2010 (JP) ..... 2010-202394

(51) Int. Cl.
*H01F 1/00* (2006.01)
*H01F 1/04* (2006.01)
*C21D 1/00* (2006.01)

(52) U.S. Cl.
USPC ..... 148/307; 148/111; 148/113; 148/565

(58) Field of Classification Search
USPC ..... 148/111, 113, 307, 565
See application file for complete search history.

(56) References Cited

U.S. PATENT DOCUMENTS

| | | | | |
|---|---|---|---|---|
| 4,750,949 | A | 6/1988 | Kobayashi et al. | |
| 4,770,720 | A | 9/1988 | Kobayashi et al. | |
| 5,853,499 | A * | 12/1998 | Komatsubara et al. | 148/113 |
| 2003/0121566 | A1 * | 7/2003 | Komatsubara et al. | 148/111 |

FOREIGN PATENT DOCUMENTS

| | | |
|---|---|---|
| JP | 56-051528 | 5/1981 |
| JP | 62-053579 | 11/1987 |
| JP | 62-054873 | 11/1987 |
| JP | 63-096216 | 4/1988 |
| JP | 03-079722 | 4/1991 |
| JP | 06-057335 | 3/1994 |
| JP | 07-268474 | 10/1995 |

(Continued)

OTHER PUBLICATIONS

International Search Report dated Dec. 13, 2011 issued in corresponding PCT Application No. PCT/JP2011/070607.

(Continued)

*Primary Examiner* — Keith Walker
*Assistant Examiner* — Alexander Polyansky
(74) *Attorney, Agent, or Firm* — Kenyon & Kenyon LLP

(57) ABSTRACT

This method of manufacturing a grain-oriented electrical steel sheet includes, between a cold rolling process and a winding process, a groove formation process of irradiating the surface of a silicon steel sheet with a laser beam multiple times at predetermined intervals in a sheet passing direction, over an area from one end edge to the other end edge, in a sheet width direction of the silicon steel sheet, thereby forming a groove along a locus of the laser beam.

2 Claims, 8 Drawing Sheets

(56) References Cited

FOREIGN PATENT DOCUMENTS

| | | |
|---|---|---|
| JP | 09-049024 | 2/1997 |
| JP | 09-268322 | 10/1997 |
| JP | 2000-109961 | 4/2000 |
| JP | 2002-294416 | 10/2002 |
| JP | 2003-129135 | 5/2003 |
| JP | 4782248 | 9/2011 |
| RU | 2 238 340 | 10/2004 |
| RU | 2 298 592 | 5/2007 |
| RU | 2 301 839 | 6/2007 |
| RU | 2 358 346 | 6/2009 |
| WO | 2009/104521 | 8/2009 |

OTHER PUBLICATIONS

Notice of Allowance dated Nov. 11, 2013 issued in corresponding Russian Application No. 2013111522 [With English Translation].

Office Action dated Nov. 13, 2013 issued in corresponding Chinese Application No. 201180042870.X [With English Translation].

* cited by examiner

GRAIN-ORIENTED ELECTRICAL STEEL SHEET AND METHOD OF MANUFACTURING THE SAME

TECHNICAL FIELD

The present invention relates to a grain-oriented electrical steel sheet that is suitable for an iron core or the like of a transformer, and a method of manufacturing the grain-oriented electrical steel sheet. This application is a national stage application of International Application No. PCT/JP2011/070607, filed Sep. 9, 2011, which claims priority to Japanese Patent Application No. 2010-202394 filed on Sep. 9, 2010, the contents of which are incorporated herein by reference.

BACKGROUND ART

As a technique for reducing iron loss of a grain-oriented electrical steel sheet, there is a technique of subdividing a magnetic domain by introducing a strain into the surface of a ferrite (Patent Document 3). However, in a wound iron core, since strain relief annealing is performed in the manufacturing process thereof, at the time of annealing, the introduced strain is relaxed, and thus the subdivision of the magnetic domain does not become sufficient.

As a method of supplementing this shortcoming, there is a technique of forming a groove in the surface of a ferrite (Patent Documents 1, 2, 4, and 5). In addition, there is a technique of forming a groove in the surface of a ferrite and also forming a crystal grain boundary ranging from a bottom portion of the groove to the rear surface of the ferrite in a sheet thickness direction (Patent Document 6).

A method of forming a groove and a grain boundary has a high improvement effect for iron loss. However, in the technique stated in Patent Document 6, productivity is significantly reduced. This is because the width of the groove is set to be in a range of 30 to 300 μm in order to obtain a desired effect and then, attachment of Sn or the like to the groove and annealing, addition of a strain to the groove, or radiation of laser light, plasma, or the like for heat treatment to the groove, is required for further formation of a crystal grain boundary. That is, it is because it is difficult to perform treatment such as the attachment of Sn, the addition of a strain, or the radiation of laser light in exact conformity with a narrow groove and it is necessary to slow a sheet passing speed extremely, in order to realize them. In Patent Document 6, a method of performing electrolytic etching is given as the method of forming a groove. However, in order to perform the electrolytic etching, it is necessary to perform application of a resist, corrosion treatment using an etching solution, removal of the resist, and cleaning. For this reason, the number of processes and the treating time significantly increase.

CITATION LIST

Patent Documents

[Patent Document 1] Japanese Examined Patent Application, Second Publication No. S62-53579

[Patent Document 2] Japanese Examined Patent Application, Second Publication No. S62-54873

[Patent Document 3] Japanese Unexamined Patent Application, First Publication No. S56-51528

[Patent Document 4] Japanese Unexamined Patent Application, First Publication No. H6-57335

[Patent Document 5] Japanese Unexamined Patent Application, First Publication No. 2003-129135

[Patent Document 6] Japanese Unexamined Patent Application, First Publication No. H7-268474

[Patent Document 7] Japanese Unexamined Patent Application, First Publication No. 2000-109961

[Patent Document 8] Japanese Unexamined Patent Application, First Publication No. H9-49024

[Patent Document 9] Japanese Unexamined Patent Application, First Publication No. H9-268322

SUMMARY OF INVENTION

Technical Problem

The present invention has an object of providing a method of manufacturing a grain-oriented electrical steel sheet, in which it is possible to industrially mass-produce a grain-oriented electrical steel sheet having low iron loss, and a grain-oriented electrical steel sheet having low iron loss.

Solution to Problem

In order to solve the above problem, thereby achieving such an object, the present invention adopts the following measures.

(1) That is, according to an aspect of the present invention, there is provided a method of manufacturing a grain-oriented electrical steel sheet including: a cold rolling process of performing a cold rolling while moving a silicon steel sheet containing Si along a sheet passing direction; a first continuous annealing process of causing a decarburization and a primary recrystallization of the silicon steel sheet; a winding process of winding the silicon steel sheet, thereby obtaining a steel sheet coil; a groove formation process of irradiating a surface of the silicon steel sheet with a laser beam multiple times at predetermined intervals in the sheet passing direction, over an area from one end edge to the other end edge, in a sheet width direction of the silicon steel sheet, thereby forming a groove along a locus of the laser beam, during the period from the cold rolling process to the winding process; a batch annealing process of causing secondary recrystallization in the steel sheet coil; a second continuous annealing process of unwinding and planarizing the steel sheet coil; and a continuous coating process of imparting tension and electrical insulation properties to the surface of the silicon steel sheet, wherein in the batch annealing process, a crystal grain boundary penetrating the silicon steel sheet from a front surface to back surface along the groove is generated, and when an average intensity of the laser beam is set to be P (W), a focusing diameter in the sheet passing direction of a focused spot of the laser beam is set to be Dl (mm), a focusing diameter in the sheet width direction is set to be Dc (mm), a scanning speed in the sheet width direction of the laser beam is set to be Vc (mm/s), an irradiation energy density Up of the laser beam is represented by the following Formula 1, and an instantaneous power density Ip of the laser beam is represented by following Formula 2, following Formulae 3 and 4 are satisfied.

$$Up=(4/\pi)\times P/(Dl\times Vc) \quad \text{(Formula 1)}$$

$$Ip=(4/\pi)\times P/(Dl\times Dc) \quad \text{(Formula 2)}$$

$$1\leq Up\leq 10(J/mm2) \quad \text{(Formula 3)}$$

$$100(kW/mm^2)\leq Ip\leq 2000(kW/mm^2) \quad \text{(Formula 4)}$$

(2) In the aspect stated in the above (1), in the groove formation process, gas may be blown onto a portion of the silicon steel sheet that is irradiated with the laser beam, at a flow rate of greater than or equal to 10 L/minute and less than or equal to 500 L/minute.

(3) According to another aspect of the present invention, there is provided a grain-oriented electrical steel sheet including: a groove formed from a locus of a laser beam that performed scanning over an area from one end edge to the other end edge in a sheet width direction; and a crystal grain boundary extending along the groove and penetrating the grain-oriented electrical steel sheet from a front surface to back surface.

(4) In the aspect stated in the above (3), the grain-oriented electrical steel sheet may further include a crystal grain in which a grain diameter thereof in the sheet width direction of the grain-oriented electrical steel sheet is greater than or equal to 10 mm and less than or equal to a sheet width and a grain diameter thereof in a longitudinal direction of the grain-oriented electrical steel sheet exceeds 0 mm and is 10 mm or less, wherein the crystal grain may be present to range from the groove to the back surface of the grain-oriented electrical steel sheet.

(5) In the aspect stated in the above (3) or (4), a glass coating may be formed in the groove, and a X-ray intensity ratio Ir of a characteristic X-ray intensity of Mg at a portion of the groove in a case where an average value of the characteristic X-ray intensity of Mg of portions other than the portion of the groove of the surface of the grain-oriented electrical steel sheet is set to be 1, in the glass coating, may be in a range of $0 \leq Ir \leq 0.9$.

Advantageous Effects of Invention

According to the above aspects of the present invention, it is possible to obtain a grain-oriented electrical steel sheet having low iron loss by a method in which it is possible to industrially mass-produce the grain-oriented electrical steel sheet.

DESCRIPTION OF EMBODIMENTS

Figure 1:
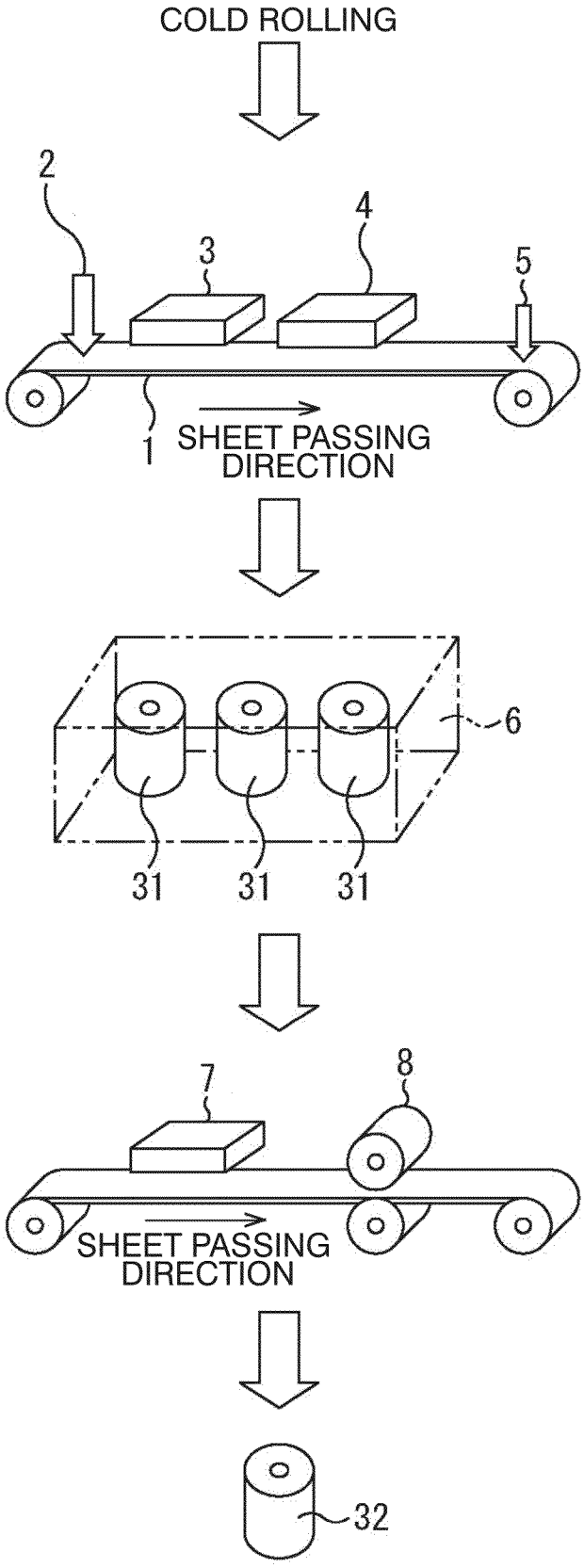
FIG. 1 is a diagram showing a method of manufacturing a grain-oriented electrical steel sheet related to an embodiment of the present invention.

Hereinafter, an embodiment of the present invention will be described with reference to the accompanying drawings. FIG. 1 is a diagram showing a method of manufacturing a grain-oriented electrical steel sheet related to the embodiment of the present invention.

In this embodiment, as shown in FIG. 1, cold rolling is performed on a silicon steel sheet 1 that contains, for example, 2% to 4% of Si, by mass %. The silicon steel sheet 1 is produced, for example, through continuous casting of molten steel, hot rolling of a slab obtained by the continuous casting, annealing of a hot-rolled steel sheet obtained by the hot rolling, and the like. The temperature of the annealing is about 1100° C., for example. The thickness of the silicon steel sheet 1 after the cold rolling is in a range of 0.2 mm to 0.3 mm, for example, and for example, after the cold rolling, the silicon steel sheet 1 is wound in the form of a coil and kept as a cold-rolled coil.

Subsequently, the coiled silicon steel sheet 1 is unwound and supplied to a decarburization annealing furnace 3 and first continuous annealing, so-called decarburization annealing is performed in the annealing furnace 3. The temperature of this annealing is in a range of 700° C. to 900° C., for example. At the time of this annealing, decarburization and primary recrystallization is caused. As a result, a crystal grain having a Goss orientation, in which an easy magnetization axis is aligned in a rolling direction, is formed with a certain degree of probability. Thereafter, the silicon steel sheet 1 discharged from the decarburization annealing furnace 3 is cooled by using a cooling device 4. Subsequently, application 5 of an annealing separating agent, containing MgO as its main constituent, to the surface of the silicon steel sheet 1 is performed. Then, the silicon steel sheet 1 with the annealing separating agent applied thereto is wound in the form of a coil, thereby being turned into a steel sheet coil 31.

Figure 2:
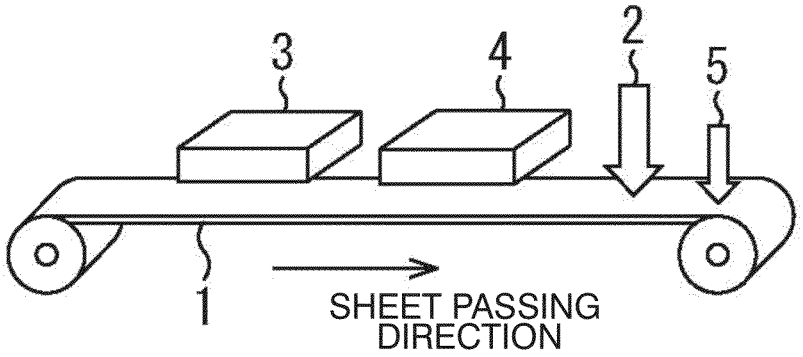
FIG. 2 is a diagram showing a modified example of the embodiment of the present invention.

In this embodiment, during the period after the coiled silicon steel sheet 1 is unwound until the silicon steel sheet 1 is supplied to the decarburization annealing furnace 3, a groove is formed in the surface of the silicon steel sheet 1 by using a laser beam irradiation device 2. At this time, the irradiation of a laser beam from one end edge toward the other end edge, in a sheet width direction of the silicon steel sheet 1, is performed multiple times at predetermined intervals with respect to a sheet passing direction, at predetermined focusing power density Ip and predetermined focusing energy density Up. As shown in FIG. 2, a configuration is also possible in which the laser beam irradiation device 2 is disposed further to the downstream side in the sheet passing direction than the cooling device 4 and the surface of the silicon steel sheet 1 is irradiated with a laser beam during the period after cooling by the cooling device 4 is performed until the application 5 of the annealing separating agent is performed. A configuration is also possible in which the laser beam irradiation devices 2 are disposed both further to the upstream side in the sheet passing direction than the annealing furnace 3 and further to the downstream side in the sheet passing direction than the cooling device 4 and the irradiation of a laser beam is performed at the both places. The irradiation of a laser beam may also be performed between the annealing furnace 3 and the cooling device 4, and may also be performed in the annealing furnace 3 or in the cooling device 4. In the formation of the groove by the laser beam, unlike a formation of the groove in machining, a melt layer that will be described later is produced. Since the melt layer does not disappear in decarburization annealing or the like, even if laser irradiation is performed at any process before secondary recrystallization, the effect thereof is obtained.

Figure 3A:
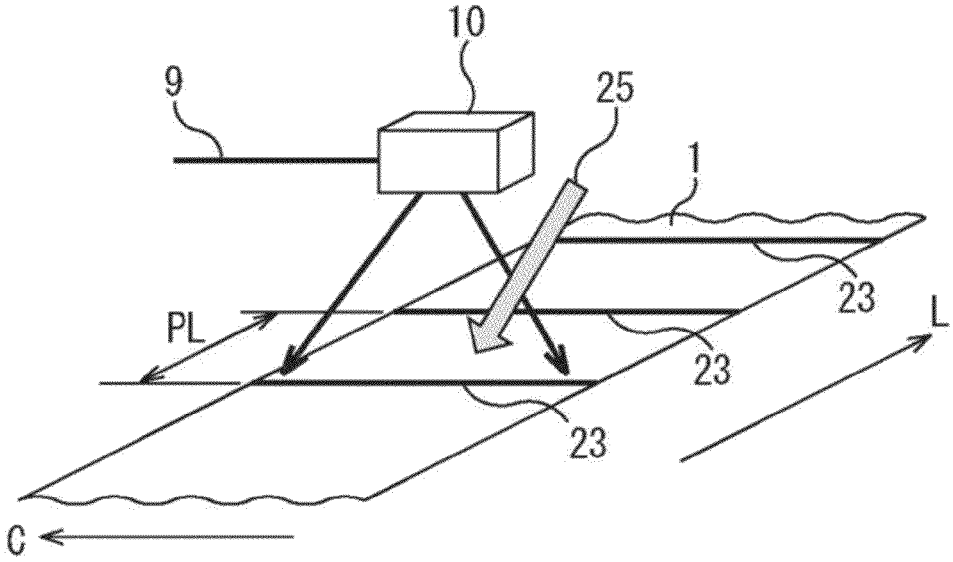
FIG. 3A is a diagram showing another example of a scanning method of a laser beam in the embodiment of the present invention.

For example, as shown in FIG. 3A, a scanning device 10 performs scanning of a laser beam 9 emitted from a laser device that is a light source, at predetermined intervals PL in a C direction that is the sheet width direction almost perpendicular to an L direction that is the rolling direction of the silicon steel sheet 1, whereby the irradiation of the laser beam is performed. At this time, assist gas 25 such as air or inert gas is blown onto a part that is irradiated with the laser beam 9, of the silicon steel sheet 1. As a result, a groove 23 is formed in a portion irradiated with the laser beam 9, of the surface of the silicon steel sheet 1. The rolling direction corresponds with the sheet passing direction.

Figure 3B:
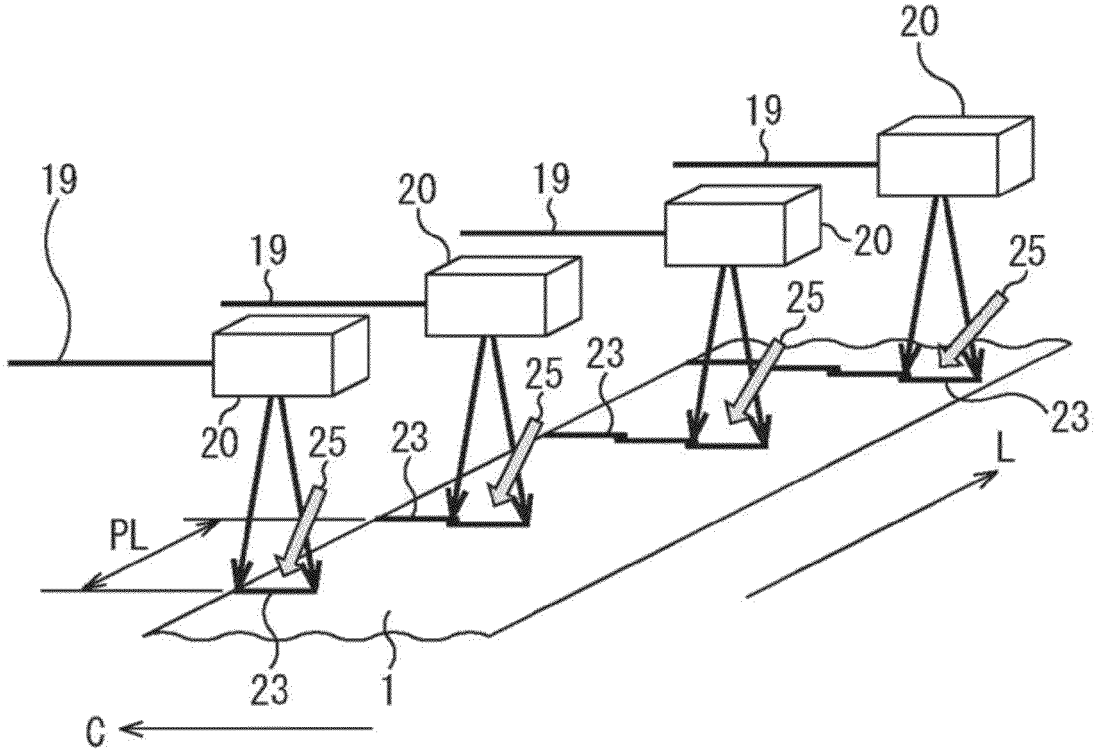
FIG. 3B is a diagram showing another example of a scanning method of a laser beam in the embodiment of the present invention.

The scanning of the laser beam over the entire width of the silicon steel sheet 1 may also be performed by a single scanning device 10 and may also be performed by a plurality of scanning devices 20, as shown in FIG. 3B. In a case in which the plurality of scanning devices 20 is used, only one laser device that is a light source of a laser beam 19 which is incident on each scanning device 20 may also be provided and one may also be provided for each scanning device 20. In a case where there is one light source, it is preferable if a laser beam emitted from the light source is divided into the laser beams 19. Since it becomes possible to divide an irradiated area into a plurality of areas in the sheet width direction by using the plurality of scanning devices 20, the times of scanning and irradiation required per laser beam are shortened. Therefore, it is particularly suitable for high-speed sheet passing equipment.

Figure 4A:
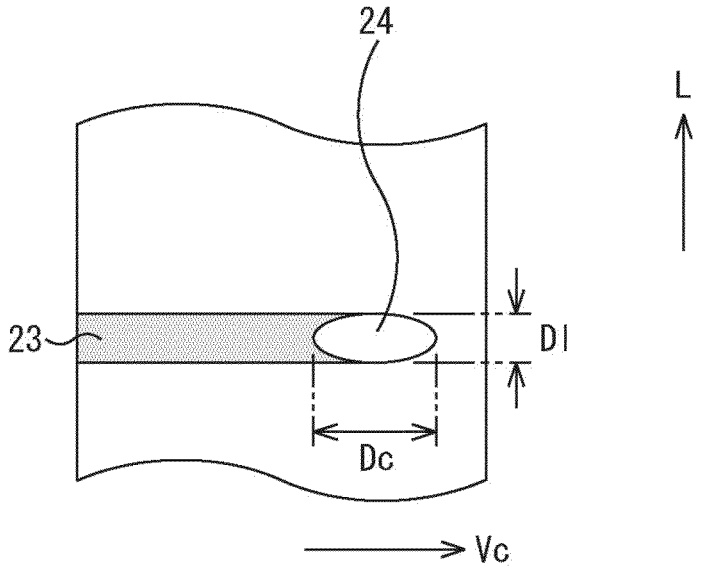
FIG. 4A is a diagram showing a focused spot of a laser beam in the embodiment of the present invention.
Figure 4B:
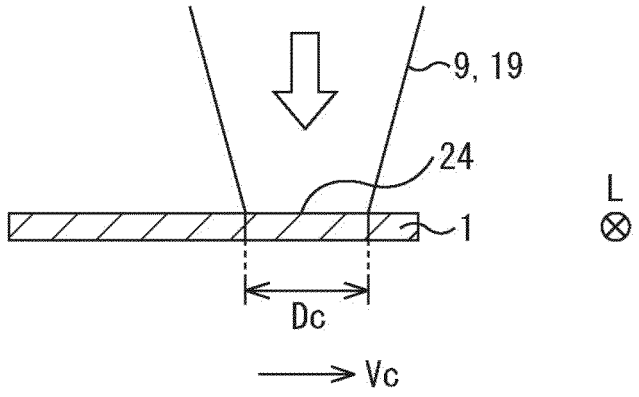
FIG. 4B is a diagram showing the focused spot of the laser beam in the embodiment of the present invention.

The laser beam 9 or 19 is focused by a lens in the scanning device 10 or 20. As shown in FIGS. 4A and 4B, the shape of a laser beam focused spot 24 of the laser beam 9 or 19 on the surface of the silicon steel sheet 1 is, for example, a circular shape or an elliptical shape in which a diameter in the C direction that is the sheet width direction is Dc and a diameter in the L direction that is the rolling direction is DI. The scanning of the laser beam 9 or 19 is performed at a speed Vc by using, for example, a polygon mirror or the like in the scanning device 10 or 20. For example, the diameter Dc in the C direction that is the sheet width direction may be set to be 0.4 mm and the diameter Dl in the L direction that is the rolling direction may be set to be 0.05 mm.

As the laser device that is the light source, for example, a $CO_2$ laser can be used. A high-power laser that is generally used for industrial purposes, such as a YAG laser, a semiconductor laser, or a fiber laser, may also be used. The laser that is used may also be any of a pulsed laser and a continuous-wave laser, provided that the groove 23 and a crystal grain 26 are stably formed.

The temperature of the silicon steel sheet 1 when performing the irradiation of the laser beam is not particularly limited. For example, the irradiation of the laser beam can be performed with respect to the silicon steel sheet 1 under about room temperature. A scanning direction of the laser beam need not correspond with the C direction that is the sheet width direction. However, from the viewpoint of work efficiency or the like and subdivision of a magnetic domain into strip shapes long in the rolling direction, it is preferable that the angle between the scanning direction and the C direction that is the sheet width direction be within 45°. It is more preferable that the angle is within 20° and it is even more preferable that the angle be within 10°.

Instantaneous power density Ip and irradiation energy density Up of the laser beam which are suitable for the formation of the groove 23 will be described. In this embodiment, for the reason described below, it is preferable that the peak power density, that is, the instantaneous power density Ip of the laser beam that is defined by Formula 2 satisfies Formula 4, and it is preferable that the irradiation energy density Up of the laser beam that is defined by Formula 1 satisfy Formula 3.

$$Up=(4/\pi)\times P/(Dl\times Vc) \quad \text{(Formula 1)}$$

$$Ip=(4/\pi)\times P/(Dl\times Dc) \quad \text{(Formula 2)}$$

$$1\leq Up\leq 10 J/mm^2 \quad \text{(Formula 3)}$$

$$100 kW/mm^2\leq Ip\leq 2000 kW/mm^2 \quad \text{(Formula 4)}$$

Here, P represents the average intensity, that is, the power (W) of the laser beam, Dl represents the diameter (mm) in the rolling direction of the focused spot of the laser beam, Dc represents the diameter (mm) in the sheet width direction of the focused spot of the laser beam, and Vc represents a scanning speed (mm/s) in the sheet width direction of the laser beam.

Figure 5:
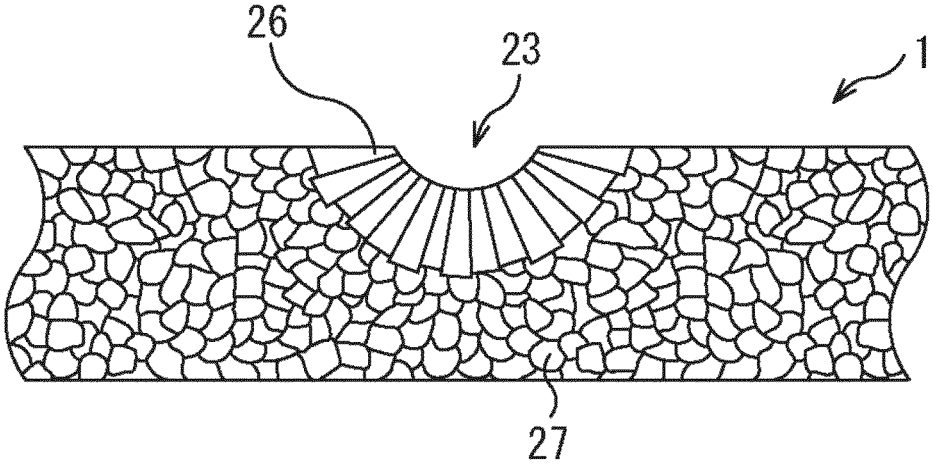
FIG. 5 is a diagram showing a groove and crystal grains which are formed in the embodiment of the present invention.

If the silicon steel sheet 1 is irradiated with the laser beam 9, an irradiated portion is melted and a portion thereof scatters or evaporates. As a result, the groove 23 is formed. A portion of the melted portion that did not scatter or evaporate remains as it is, and is solidified after the ending of irradiation of the laser beam 9. At the time of the solidification, as shown in FIG. 5, a columnar crystal extending long toward the inside of the silicon steel sheet from the bottom of the groove, and/or a crystal grain having a large grain diameter compared to a laser non-irradiated portion, that is, the crystal grain 26 having a different shape from a crystal grain 27 obtained by primary recrystallization are formed. The crystal grain 26 becomes the starting point of crystal grain boundary growth at the time of secondary recrystallization.

If the instantaneous power density Ip described above is less than 100 $kW/mm^2$, it becomes difficult to sufficiently cause the melting and the scattering or the evaporation of the silicon steel sheet 1. That is, it becomes difficult to form the groove 23. On the other hand, if the instantaneous power density Ip exceeds 2000 $kW/mm^2$, most of the molted steel scatters or evaporates, and thus the crystal grain 26 is not easily formed. If the irradiation energy density Up exceeds 10 $J/mm^2$, a melting portion of the silicon steel sheet 1 is increased, and thus the silicon steel sheet 1 is easily deformed. On the other hand, if the irradiation energy density is less than 1 $J/mm^2$, the improvement in magnetic characteristics does not appear. For these reasons, it is preferable that Formulae 3 and 4 described above are satisfied.

At the time of the irradiation of the laser beam, the assist gas 25 is blown in order to remove components scattered or evaporated from the silicon steel sheet 1, from an irradiation path of the laser beam 9. Since the laser beam 9 stably reaches the silicon steel sheet 1 due to the blowing, the groove 23 is stably formed. Further, the assist gas 25 is blown, whereby reattachment of the components to the silicon steel sheet 1 can be suppressed. In order to sufficiently obtain these effects, it is preferable that the flow rate of the assist gas 25 be greater than or equal to 10 L (liter)/minute. On the other hand, if the flow rate exceeds 500 L/minute, the effect is saturated and the cost also increases. For this reason, it is preferable that the upper limit is set to be 500 L/minute.

The preferable conditions described above are also the same in a case where the irradiation of the laser beam is performed between decarburization annealing and finish annealing and a case where the irradiation of the laser beam is performed before and after decarburization annealing.

Returning to the description using FIG. 1, after the application 5 of the annealing separating agent and the winding, as shown in FIG. 1, the steel sheet coil 31 is transported into an annealing furnace 6 and placed with the central axis of the steel sheet coil 31 being almost in the vertical direction. Thereafter, batch annealing, that is, finish annealing of the steel sheet coil 31 is performed in a batch treatment. The highest temperature of the batch annealing to be achieved is set to be about 1200° C., for example, and a retention time is set to be about 20 hours, for example. At the time of the batch annealing, secondary recrystallization is caused and also a glass coating is formed on the surface of the silicon steel sheet 1. Thereafter, the steel sheet coil 31 is taken out of the annealing furnace 6.

In the glass coating obtained by the above-described aspect, it is desirable that an X-ray intensity ratio Ir of the characteristic X-ray intensity of Mg of a groove portion, in a case where the average value of the characteristic X-ray intensity of Mg of portions other than the groove portion of the surface of a grain-oriented electrical steel sheet is set to be 1, is in a range of $0 \leq Ir \leq 0.9$. If it is in the range, a favorable iron loss characteristic is obtained.

The X-ray intensity ratio is obtained by measurement using an EPMA (Electron Probe MicroAnalyser) or the like.

Subsequently, the steel sheet coil 31 is unwound and supplied to an annealing furnace 7 and second continuous annealing, so-called planarization annealing, is performed in the annealing furnace 7. At the time of the second continuous annealing, curling and strain deformation generated at the time of the finish annealing are eliminated, and thus the silicon steel sheet 1 becomes flat. As the annealing conditions, for example, retention of greater than or equal to 10 seconds and less than or equal to 120 seconds can be performed at temperature greater than or equal to 700° C. and less than or equal to 900° C. Subsequently, coating 8 on the surface of the silicon steel sheet 1 is performed. In the coating 8, a material, in which securing of electrical insulation properties and the action of tension to reduce iron loss are possible, is coated. A grain-oriented electrical steel sheet 32 is produced through a series of these processes. After a coating is formed by the coating 8, for the convenience of, for example, storage, transport, and the like, the grain-oriented electrical steel sheet 32 is wound in the form of a coil.

Figure 6A:
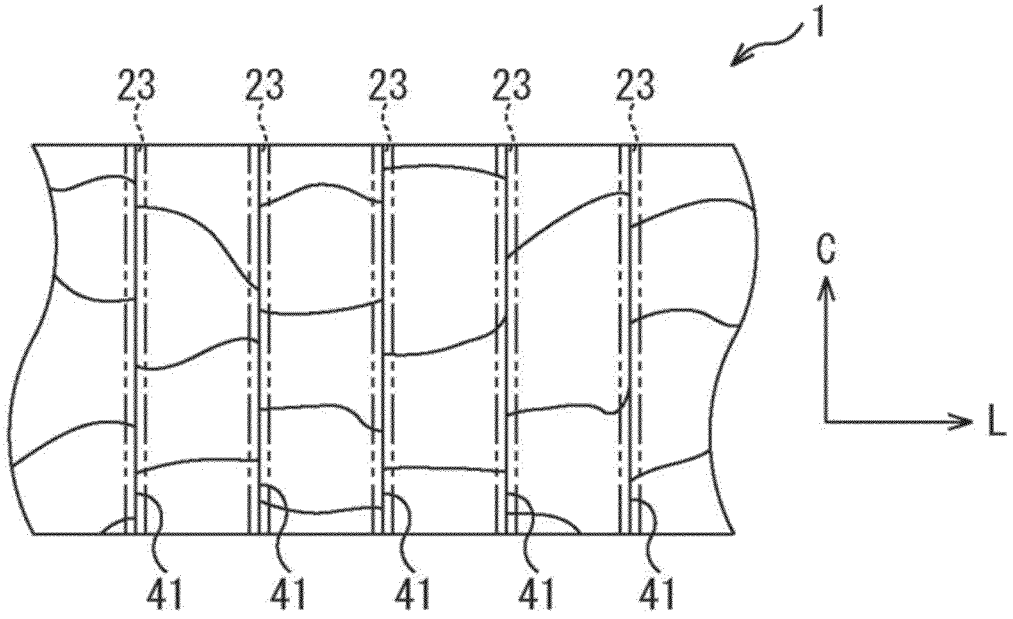
FIG. 6A is a diagram showing crystal grain boundaries which are formed in the embodiment of the present invention.
Figure 6B:
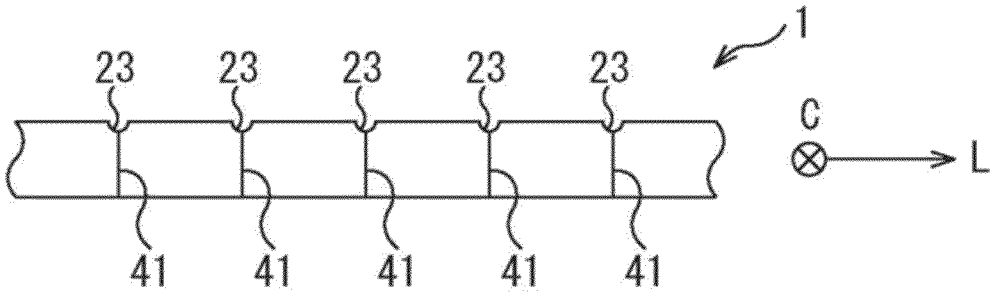
FIG. 6B is a diagram showing the crystal grain boundaries which are formed in the embodiment of the present invention.

If the grain-oriented electrical steel sheet 32 is produced by the above-described method, at the time of the secondary recrystallization, as shown in FIGS. 6A and 6B, a crystal grain boundary 41 penetrating the silicon steel sheet 1 from front surface to back surface along the groove 23 is formed. This is caused by the fact that the crystal grain 26 remains until the terminal phase of the secondary recrystallization because the crystal grain 26 is not easily eroded in a crystal grain having a Goss orientation and that although the crystal grain 26 is eventually absorbed into the crystal grain having a Goss orientation, at that time, crystal grains greatly growing from both sides of the groove 23 cannot erode each other.

Figure 7A:
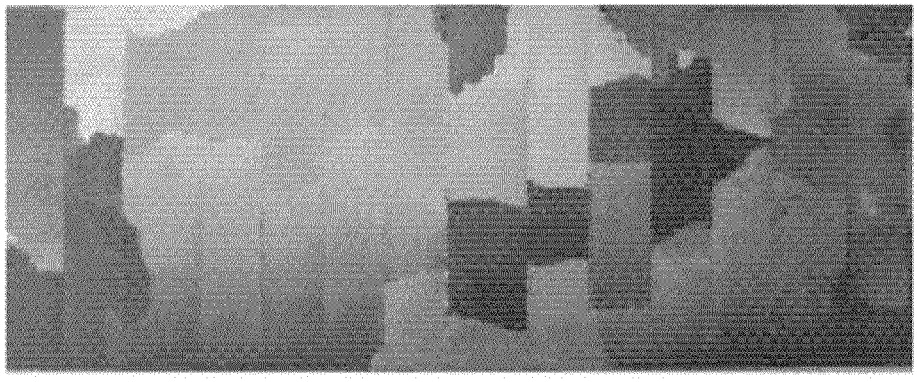
FIG. 7A is a diagram showing a photograph of the surface of a silicon steel sheet in the embodiment of the present invention.

In the grain-oriented electrical steel sheet produced according to the above-described embodiment, crystal grain boundaries shown in FIG. 7A were observed. In the crystal grain boundaries, the crystal grain boundary 41 formed along the groove was included. Further, in a grain-oriented electrical steel sheet produced according to the above-described embodiment except that the irradiation of the laser beam is omitted, crystal grain boundaries shown in FIG. 7B were observed.

Figure 7B:
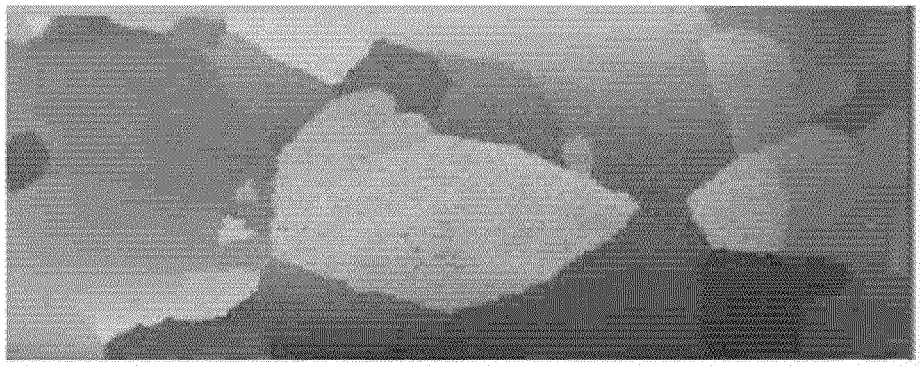
FIG. 7B is a diagram showing a photograph of the surface of a silicon steel sheet in an embodiment of a comparative example.

FIGS. 7A and 7B are photographs taken with pickling of the surface of the grain-oriented electrical steel sheet performed after the glass coating or the like is removed from the surface of the grain-oriented electrical steel sheet, and ferrite is exposed. In these photographs, the crystal grains and the crystal grain boundaries obtained by the secondary recrystallization appear.

In the grain-oriented electrical steel sheet produced by the above-described method, the effect of magnetic domain subdivision is obtained by the grooves 23 formed in the surface of the ferrite. Further, the effect of magnetic domain subdivision is also obtained by the crystal grain boundaries 41 penetrating the silicon steel sheet 1 from the front surface to the back surface along the grooves 23. Iron loss can be further reduced due to the synergistic effect thereof.

Since the groove 23 is formed by the irradiation of a predetermined laser beam, the formation of the crystal grain boundary 41 is very easy. That is, after the formation of the groove 23, it is not necessary to perform alignment or the like based on the position of the groove 23 for the formation of the crystal grain boundary 41. Therefore, a significant decrease in sheet passing speed or the like is not necessary, and thus it is possible to industrially mass-produce a grain-oriented electrical steel sheet.

It is possible to perform the irradiation of the laser beam at high speed, and high-energy density is obtained by light-focusing into a minute space. Therefore, even compared with a case where the irradiation of a laser beam is not performed, an increase in time required for treatment is small. That is, regardless of the presence or absence of the irradiation of a laser beam, it is almost not necessary to change a sheet passing speed in treatment performing decarburization annealing or the like while unwinding a cold-rolled coil. In addition, since the temperature at which the irradiation of a laser beam is performed is not limited, a heat-insulating mechanism or the like of a laser irradiation device is unnecessary. Therefore, compared to a case where treatment in a high-temperature furnace is necessary, the configuration of an apparatus can be simplified.

The depth of the groove 23 is not particularly limited. However, it is preferable that the depth is greater than or equal to 1 μm and less than or equal to 30 μm. If the depth of the groove 23 is less than 1 μm, subdivision of a magnetic domain sometimes does not become sufficient. If the depth of the groove 23 exceeds 30 μm, the amount of a silicon steel sheet that is a magnetic material, that is, the amount of a ferrite is reduced and magnetic flux density is reduced. More preferably, the depth of the groove 23 is greater than or equal to 10 μm and less than or equal to 20 μm. The groove 23 may also be formed in only one surface of a silicon steel sheet and may also be formed in both surfaces.

The interval PL between the grooves 23 is not particularly limited. However, it is preferable that the interval PL is greater than or equal to 2 mm and less than or equal to 10 mm. If the interval PL is less than 2 mm, inhibition of the formation of a magnetic flux by the groove becomes noticeable and it becomes difficult for the sufficiently high magnetic flux density required for a transformer to be formed. On the other hand, if the interval PL exceeds 10 mm, the effect of improving a magnetic characteristic by a groove and a grain boundary is greatly reduced.

Figure 8A:
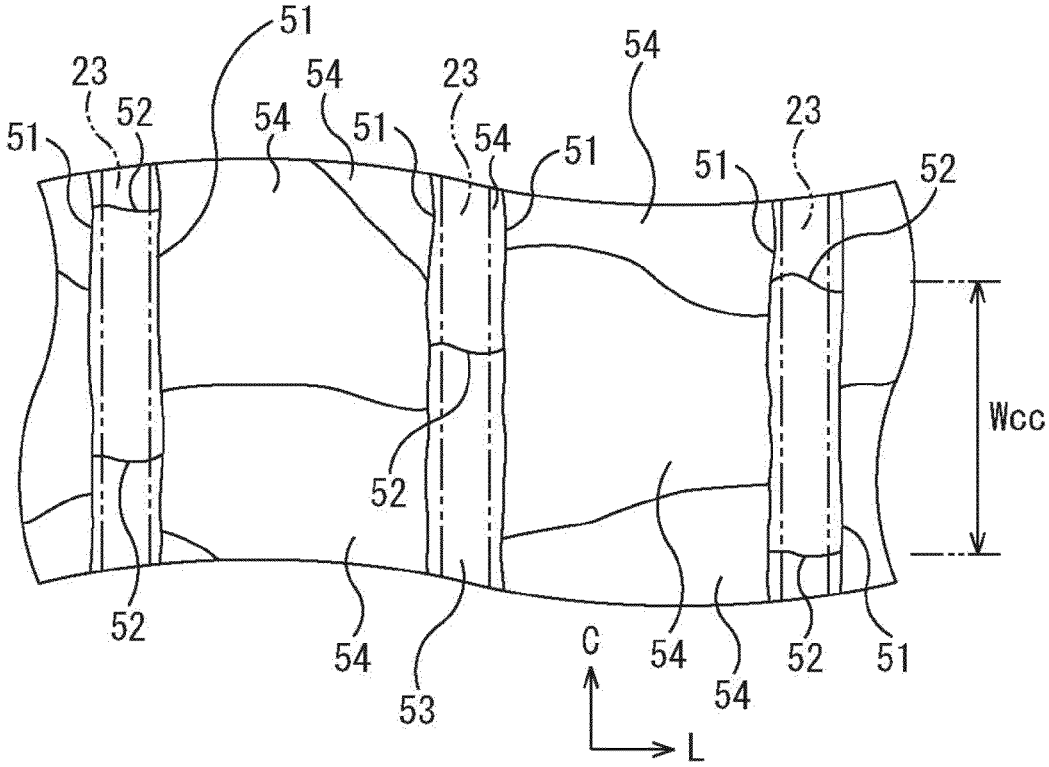
FIG. 8A is a diagram showing another example of the crystal grain boundary in the embodiment of the present invention.
Figure 8B:
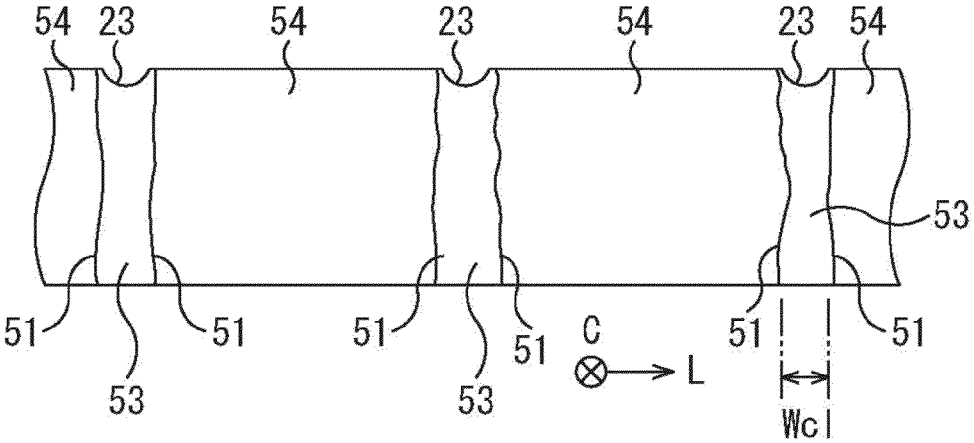
FIG. 8B is a diagram showing another example of the crystal grain boundary in the embodiment of the present invention.

In the embodiment described above, one crystal grain boundary 41 is formed along one groove 23. However, for example, in a case where the width of the groove 23 is wide and the crystal grains 26 are formed over a wide range in the rolling direction, at the time of the secondary recrystallization, some of the crystal grains 26 sometimes grow earlier than other crystal grains 26. In this case, as shown in FIGS. 8A and 8B, a plurality of crystal grains 53 each having a certain degree of width and along the groove 23 is formed below the grooves 23 in a sheet thickness direction. It is acceptable if a grain diameter Wc1 in the rolling direction of the crystal grain 53 exceeds 0 mm, and the grain diameter Wc1 becomes greater than or equal to, for example, 1 mm. However, the grain diameter Wc1 tends to become less than or equal to 10 mm. The reason that the grain diameter Wc1 tends to become less than or equal to 10 mm is because a crystal grain growing with the highest priority at the time of the secondary recrystallization is a crystal grain 54 having a Goss orientation and growth is hindered by the crystal grain 54. A crystal grain boundary 51 approximately parallel to the groove 23 is present between the crystal grain 53 and the crystal grain 54. A crystal grain boundary 52 is present between adjacent crystal grains 53. A grain diameter Wee in the sheet width direction of the crystal grain 53 tends to become greater than or equal to, for example, 10 mm. The crystal grain 53 may also be present as a single crystal grain in the width direction over the entire sheet width, and in this case, the crystal grain boundary 52 need not be present. With respect to the grain diameter, for example, it can be measured by the following method. After the glass coating is removed and pickling is performed so as to expose the ferrite, a field of view of 300 mm in the rolling direction and 100 mm in the sheet width direction is observed, dimensions in the rolling direction and the sheet width direction of the crystal grain are measured by viewing and by image processing, and the average value thereof is obtained.

The crystal grain 53 extending along the groove 23 is not necessarily a crystal grain having a Goss orientation. However, since the size thereof is limited, an influence on a magnetic characteristic is very small.

In Patent Documents 1 to 9, a feature that a groove is formed by the irradiation of a laser beam is not stated and further, a crystal grain boundary extending along the groove is created at the time of secondary recrystallization, as in the above-described embodiment. That is, even if the irradiation of a laser beam is stated, since timing or the like of the irradiation is not appropriate, it is not possible to obtain the effects that are obtained in the above-described embodiment.

EXAMPLES

First Experiment

In a first experiment, hot rolling, annealing, and cold rolling of a steel material for oriented electrical steel were performed, the thickness of the silicon steel sheet was set to be 0.23 mm, and the silicon steel sheet was wound, thereby being turned into a cold-rolled coil. Five cold-rolled coils were produced. Subsequently, with respect to three cold-rolled coils related to Example Nos. 1, 2, and 3, the formation of the groove by the irradiation of the laser beam was performed and thereafter, the decarburization annealing was performed, thereby causing the primary recrystallization. The irradiation of the laser beam was performed by using a fiber laser. In all the examples, the power P was 2000 W, and with respect to a focused shape, in Example Nos. 1 and 2, the diameter Dl in the L direction was 0.05 mm and the diameter Dc in the C direction was 0.4 mm. With respect to Example No. 3, the diameter Dl in the L direction was 0.04 mm and the diameter Dc in the C direction was 0.04 mm. The scanning speed Vc was set to be 10 m/s in Example Nos. 1 and 3 and 50 m/s in Example No. 2. Therefore, the instantaneous power density Ip was 127 kW/mm$^2$ in Example Nos. 1 and 2 and 1600 kW/mm$^2$ in Example No. 3. The irradiation energy density Up was 5.1 J/mm$^2$ in Example No. 1, 1.0 J/mm$^2$ in Example No. 2, and 6.4 J/mm$^2$ in Example No. 3. The irradiation pitch PL was set to be 4 mm, and air was blown at a flow rate of 15 L/minute as the assist gas. As a result, the width of the formed groove was about 0.06 mm, that is, 60 μm in Example Nos. 1 and 3 and 0.05 mm, that is, 50 μm in Example No. 2. The depth of the groove was about 0.02 mm, that is, 20 μm in Example No. 1, 3 μm in Example No. 2, and 30 μm in Example No. 3. Variation in the width was within ±5 μm, and variation in the depth was within ±2 μm.

With respect to another cold-rolled coil related to Comparative Example No. 1, the formation of a groove by etching was performed and thereafter, decarburization annealing was performed, thereby causing primary recrystallization. The shape of this groove was made to be the same as the shape of the groove in Example No. 1 formed by the irradiation of the laser beam described above. With respect to the remaining one cold-rolled coil related to Comparative Example No. 2, the formation of a groove was not performed and thereafter, decarburization annealing was performed, thereby causing primary recrystallization.

In all of Example Nos. 1 to 3 and Comparative Example Nos. 1 and 2, after the decarburization annealing, application of an annealing separating agent, finish annealing, planarization annealing, and coating were performed on the silicon steel sheets. In this way, five kinds of grain-oriented electrical steel sheets were produced.

When the structures of these grain-oriented electrical steel sheets were observed, in all of Example Nos. 1 to 3 and Comparative Example Nos. 1 and 2, secondary recrystallized grains formed by secondary recrystallization were present. In Example Nos. 1 to 3, similarly to the crystal grain boundary 41 shown in FIG. 6A or 6B, the crystal grain boundary along the groove was present. However, in Comparative Example Nos. 1 and 2, such a crystal grain boundary was not present.

Thirty single sheets each having a length in the rolling direction of 300 mm and a length in the sheet width direction of 60 mm were sampled from each of the grain-oriented electrical steel sheets respectively, and the average value of the magnetic characteristics was measured by a single sheet magnetometric method (SST: Single Sheet Test). The measurement method was carried out in conformity with IEC60404-3:1982. As the magnetic characteristics, magnetic flux density $B_8$ (T) and iron loss $W_{17/50}$ (W/kg) were measured. The magnetic flux density $B_8$ is magnetic flux density that is generated in a grain-oriented electrical steel sheet at a magnetizing force of 800 A/m. Since the larger the value of the magnetic flux density $B_8$ of a grain-oriented electrical steel sheet, the larger the magnetic flux density that is generated at a certain magnetizing force, the grain-oriented electrical steel sheet in which the value of the magnetic flux density $B_8$ is large is suitable for a small and efficient transformer. The iron loss $W_{17/50}$ is iron loss when a grain-oriented electrical steel sheet is subjected to alternating-current energization under conditions in which the maximum magnetic flux density is 1.7 T and a frequency is 50 Hz. The smaller the value of the iron loss $W_{17/50}$ of a grain-oriented electrical steel sheet, the lower the energy loss, and thus the grain-oriented electrical steel sheet in which the value of the iron loss $W_{17/50}$ is small is suitable for a transformer. The average value of each of the magnetic flux density $B_8$ (T) and the iron loss $W_{17/50}$ (W/kg) is shown in Table 1 below. Further, with respect to the single sheet samples described above, the measurement of the X-ray intensity ratio Ir was performed by using the EPMA. Each average value is shown together in Table 1 below.

TABLE 1

| | Average value of $B_8$ (T) | Average value of $W_{17/50}$ (W/kg) | Average value of Ir |
|---|---|---|---|
| Example No. 1 | 1.89 | 0.74 | 0.5 |
| Example No. 2 | 1.90 | 0.76 | 0.9 |
| Example No. 3 | 1.87 | 0.75 | 0.1 |
| Comparative Example No. 1 | 1.88 | 0.77 | 1.0 |
| Comparative Example No. 2 | 1.91 | 0.83 | 1.0 |

As shown in Table 1, in Example Nos. 1 to 3, compared with Comparative Example No. 2, the magnetic flux density $B_8$ was low with the formation of the groove. However, since the groove and the crystal grain boundary along the groove were present, the iron loss was significantly low. In Example Nos. 1 to 3, even compared with Comparative Example No. 1, since the crystal grain boundary along the groove was present, the iron loss was low.

Second Experiment

In a second experiment, verification regarding the irradiation conditions of the laser beam was performed. Here, the irradiation of the laser beam was performed in four types of conditions described below.

In a first condition among the four type conditions, a continuous-wave fiber laser was used. The power P was set to be 2000 W, the diameter Dl in the L direction was set to be 0.05 mm, the diameter Dc in the C direction was set to be 0.4 mm, and the scanning speed Vc was set to be 5 m/s. Therefore, the instantaneous power density Ip was 127 kW/mm$^2$ and the irradiation energy density Up was 10.2 J/mm$^2$. That is, compared to the conditions of the first experiment, the scanning speed was reduced by half, and thus the irradiation energy density Up was doubled. Therefore, the first condition does not satisfy Formula 3. As a result, warp deformation of the steel sheet was generated with an irradiated portion as the starting point. Since a warp angle reached a range of 3° to 10°, winding into the form of a coil was difficult.

Also in a second condition, a continuous-wave fiber laser was used. Further, the power P was set to be 2000 W, the diameter Dl in the L direction was set to be 0.10 mm, the diameter Dc in the C direction was set to be 0.3 mm, and the scanning speed Vc was set to be 10 m/s. Therefore, the instantaneous power density Ip was 85 kW/mm$^2$ and the irradiation energy density Up was 2.5 J/mm$^2$. That is, compared to the conditions of the first experiment, the diameter Dl in the L direction and the diameter Dc in the C direction are changed, and thus the instantaneous power density Ip was set to be small. The second condition does not satisfy Formula 4. As a result, it was difficult to form a grain boundary that could penetrate.

Also in a third condition, a continuous-wave fiber laser was used. The power P was set to be 2000 W, the diameter Dl in the L direction was set to be 0.03 mm, the diameter Dc in the C direction was set to be 0.03 mm, and the scanning speed Vc was set to be 10 m/s. Therefore, the instantaneous power density Ip was 2800 kW/mm$^2$ and the irradiation energy density Up was 8.5 J/mm$^2$. That is, the diameter Dl in the L direction was set to be smaller than in the condition of the first experiment, and thus the instantaneous power density Ip was set to be large. Therefore, the third condition does not also satisfy Formula 4. As a result, it was difficult to sufficiently form a crystal grain boundary along the groove.

Also in a fourth condition, a continuous-wave fiber laser was used. The power P was set to be 2000 W, the diameter Dl in the L direction was set to be 0.05 mm, the diameter Dc in the C direction was set to be 0.4 mm, and the scanning speed Vc was set to be 60 m/s. Therefore, the instantaneous power density Ip was 127 kW/mm$^2$ and the irradiation energy density Up was 0.8 J/mm$^2$. That is, the scanning speed was set to be larger than the condition of the first experiment, and thus the irradiation energy density Up was set to be small. The fourth condition does not satisfy Formula 3. As a result, in the fourth condition, it was difficult to form a groove having a depth of greater than or equal to 1 μm.

Third Experiment

In a third experiment, the irradiation of the laser beam was performed under two sets of conditions, a condition in which the flow rate of the assist gas was set to be less than 10 L/minute and a condition in which the assist gas is not supplied. As a result, it was difficult to stabilize the depth of the groove, variation in the width of the groove was greater than or equal to range of ±10 μm, and variation in the depth was greater than or equal to range of ±5 μm. For this reason, variation in magnetic characteristics was large, compared with the examples.

INDUSTRIAL APPLICABILITY

According to an aspect of the present invention, a grain-oriented electrical steel sheet having low iron loss can be obtained by a method in which it is possible to industrially mass-produce the grain-oriented electrical steel sheet.

REFERENCE SIGNS LIST

1: silicon steel sheet
2: laser beam irradiation device
3, 6, 7: annealing furnace
31: steel sheet coil
32: grain-oriented electrical steel sheet
9, 19: laser beam
10, 20: scanning device
23: groove
24: laser beam focused spot
25: assist gas
26, 27, 53, 54: crystal grain
41, 51, 52: crystal grain boundary

The invention claimed is:

1. A grain-oriented electrical steel sheet comprising:

a groove formed from a locus of a laser beam scanned over an area from one end edge to the other end edge in a sheet width direction; and a crystal grain boundary which extends along the groove and penetrates the grain-oriented electrical steel sheet from a front surface to a back surface, wherein a glass coating is formed in the groove, wherein in the glass coating, an X-ray intensity ratio (Ir) of a characteristic X-ray intensity of Mg at a portion of the groove is in a range of $0 \leq Ir \leq 0.9$, and wherein an average value of the characteristic X-ray intensity of Mg of portions other than the portion of the groove of the surface of the grain-oriented electrical steel sheet is set to be 1.

2. The grain-oriented electrical steel sheet according to claim 1, further comprising a crystal grain in which a grain diameter thereof in the sheet width direction of the grain-oriented electrical steel sheet is greater than or equal to 10 mm and less than or equal to a sheet width and a grain diameter thereof in a longitudinal direction of the grain-oriented electrical steel sheet exceeds 0 mm and is 10 mm or less, wherein the crystal grain is present to over a range from the groove to the back surface of the grain-oriented electrical steel sheet.

* * * * *

UNITED STATES PATENT AND TRADEMARK OFFICE

CERTIFICATE OF CORRECTION

PATENT NO. : 8,657,968 B2
APPLICATION NO. : 13/816773
DATED : February 25, 2014
INVENTOR(S) : Tatsuhiko Sakai et al.

It is certified that error appears in the above-identified patent and that said Letters Patent is hereby corrected as shown below:

In the Specification

Column 5, line 43, change "DI" to -- D1 --;

Column 9, line 20, change "Wee" to -- Wcc --.

Signed and Sealed this
Fourteenth Day of October, 2014

Michelle K. Lee

Michelle K. Lee
*Deputy Director of the United States Patent and Trademark Office*